US005878442A

United States Patent [19]

Pejak

[11] Patent Number: 5,878,442

[45] Date of Patent: Mar. 9, 1999

[54] THERMAL PANTY HOSE GARMENT

[76] Inventor: Helen Pejak, 1030 Whispering Wood Dr., Mississauga, Ontario, Canada, L5C 3Z4

[21] Appl. No.: 978,623

[22] Filed: Nov. 25, 1997

[51] Int. Cl.[6] ..... A41B 11/00

[52] U.S. Cl. ..... 2/409; 2/239

[58] Field of Search ..... 2/409, 239; 66/178 R, 66/196

[56] References Cited

U.S. PATENT DOCUMENTS 5,040,245 8/1991 Staley ..... 2/409

OTHER PUBLICATIONS

Cabela's 1994 Annual Fall Catalog, p. 139 "Thinsulate/Gortex" Socks.

*Primary Examiner*—Gloria Hale

[57] ABSTRACT

A Thermal panty hose garment including a lower truck portion, two leg sections and feet sections being integrally knitted together. The two leg sections are characterized by at least three layers of fabric consisting of lycraspandex, nylon and an insulated polyester material (THINSULATE). The feet sections are each fabricated of spandex, nylon and a insulated polyester material (THINSULATE) and have a toe portion. The insulated polyester material (THINSULATE) is superimposed over the nylon and the spandex is superimposed on the insulated polyester material (THINSULATE). The insulated polyester material (THINSULATE) provides insulation for protecting the lower torso from cold temperatures.

5 Claims, 2 Drawing Sheets

THERMAL PANTY HOSE GARMENT

BACKGROUND OF THE INVENTION

1. Field of the Invention

The present invention relates to a Thermal panty hose garment and more particularly pertains to providing ladies panty hose of the type which will cover the lower torso and the feet of the wearer while offering thermal protection to those body parts.

2. Description of the Prior Art

The use of thermal underwear is known in the prior art. More specifically, thermal underwear heretofore devised and utilized for the purpose of protection against cold temperatures are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,351,068 to Taylor discloses panty hose garments. U.S. Pat. No. Des. 243,641 to Alvarez discloses pantyhose. U.S. Pat. No. Des. 289,225 to Amersin discloses pantyhose. U.S. Pat. No. 4,213,312 to Safrit, Cassidy, Cothran and Farrell discloses panty hose with a stretch-cotton panty. U.S. Pat. No. 5,404,245 to Staley discloses an undergarment having stretch panels. Lastly, U.S. Pat. No. 3,933,013 to Cassidy discloses a control panty hose.

In this respect, the Thermal panty hose garment according to the present invention substantially departs from the conventional concepts and designs of the prior art, and in so doing provides an apparatus primarily developed for the purpose of providing ladies panty hose of the type which will cover the lower torso and the feet of the wearer while offering thermal protection to those body parts.

Therefore, it can be appreciated that there exists a continuing need for a new and improved thermal panty hose garment which can be used for providing ladies panty hose of the type which will cover the lower torso and the feet of the wearer while offering thermal protection to those body parts. In this regard, the present invention substantially fulfills this need.

SUMMARY OF THE INVENTION

In view of the foregoing disadvantages inherent in the known types of thermal underwear now present in the prior art, the present invention provides an improved thermal panty hose garment. As such, the general purpose of the present invention, which will be described subsequently in greater detail, is to provide a new and improved thermal panty hose garment which has all the advantages of the prior art and none of the disadvantages.

To attain this, the present invention essentially comprises a lower trunk portion, two leg sections and feet sections that are integrally knitted together. The lower trunk portion is characterized by a spandex LYCRA fabric that has substantially stretchable and retractable conforming fit characteristics. The two leg sections are characterized by at least three layers of fabric consisting of spandex LYCRA, nylon and a THINSULATE insulated polyester material. The feet sections are each fabricated of spandex, nylon and a THINSULATE insulated polyester material and having a toe portion. The toe portion has a reinforcing weave of yarn. The three layers of fabric having the nylon being substantially throughout and being 80% of the main body yarn. The nylon is adjacent the skin of the wearer. The THINSULATE insulated polyester material is superimposed over the nylon and the spandex is superimposed on the THINSULATE insulated polyester material. The THINSULATE insulated polyester material provides insulation for protecting the lower torso from cold temperatures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved thermal panty hose garment which has all the advantages of the prior art thermal underwear and none of the disadvantages.

It is another object of the present invention to provide a new and improved thermal panty hose garment which may be easily and efficiently manufactured and marketed.

It is a further object of the present invention to provide a new and improved thermal panty hose garment which is of a durable and reliable construction.

An even further object of the present invention is to provide a new and improved thermal panty hose garment which is susceptible of a low cost of manufacture with regard to both materials and labor, and which accordingly is then susceptible of low prices of sale to the consuming public, thereby making such thermal panty hose garment economically available to the buying public.

Still yet another object of the present invention is to provide a new and improved thermal panty hose garment which provides in the apparatuses and methods of the prior art some of the advantages thereof, while simultaneously overcoming some of the disadvantages normally associated therewith.

Still another object of the present invention is to providing ladies panty hose of the type which will cover the lower torso and the feet of the wearer while offering thermal protection to those body parts.

Lastly, it is an object of the present invention to provide a new and improved panty hose that has a lower trunk portion, two leg sections and feet sections being integrally knitted together. The two leg sections are characterized by at least three layers of fabric consisting of spandex, nylon and a THINSULATE an insulated polyester material. The feet sections are each fabricated of spandex, nylon and a THINSULATE insulated polyester material and have a toe portion. The thinsulated material is superimposed over the nylon and the spandex is superimposed on the THINSULATE insulated polyester material. The thinsulated material provides insulation for protecting the lower torso from cold temperatures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
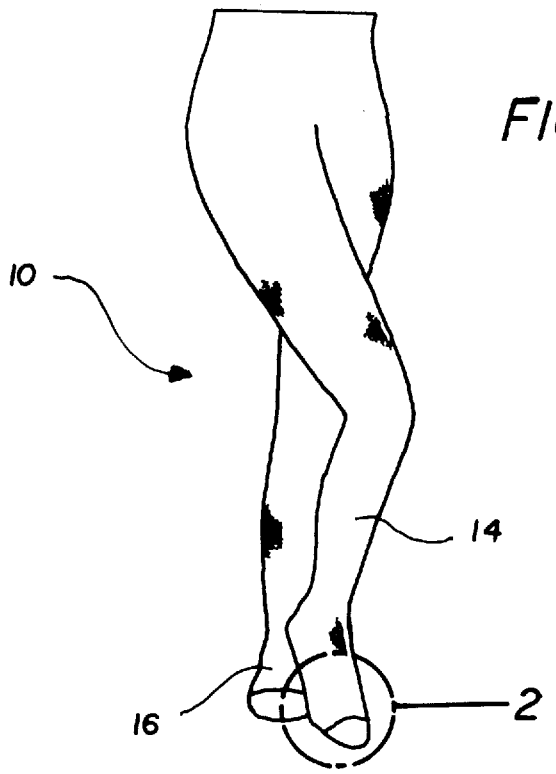
FIG. 1 is a perspective illustration of the preferred embodiment of the thermal panty hose garment constructed in accordance with the principles of the present invention.

With reference now to the drawings, and in particular to FIG. 1 thereof, a new and improved thermal panty hose garment embodying the principles and concepts of the present invention and generally designated by the reference numeral 10 will be described.

The present invention, the new and improved thermal panty hose garment, is comprised of a plurality of components. Such components in their broadest context include spandex, THINSULATE and nylon. Such components are individually configured and correlated with respect to each other so as to attain the desired objective.

More specifically, the present invention includes a lower trunk portion 12, two leg sections 14 and feet sections 16 that are integrally knitted together, as shown in FIG. 1. The lower trunk portion is characterized by a spandex fabric 18 having substantially stretchable and retractable conforming fit characteristics. The two leg sections are characterized by at least three layers of fabric consisting of spandex 18, nylon 20 and a THINSULATE material 22. The feet sections are each fabricated of LYCRA spandex, nylon and an insulated polyester material. Additionally, the feet sections each have a toe portion 24.

Figure 2:
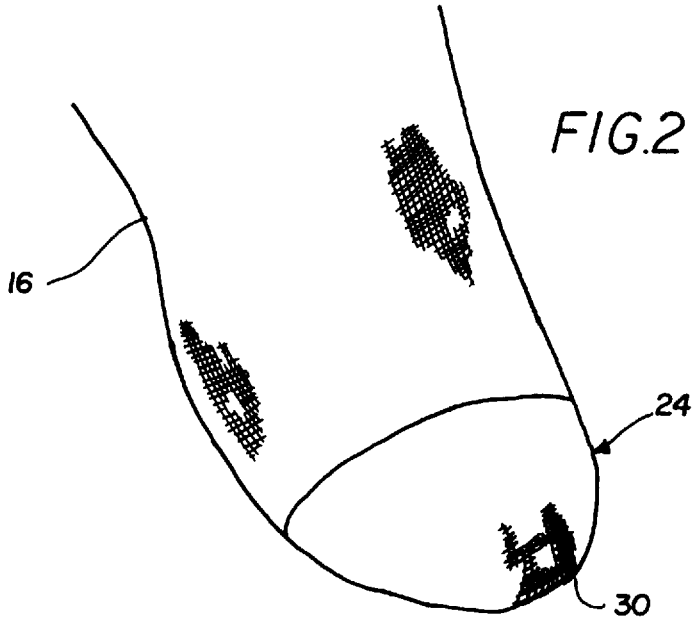
FIG. 2 is an enlarged view of the toe portion taken at position 2 of FIG. 1.
Figure 3:
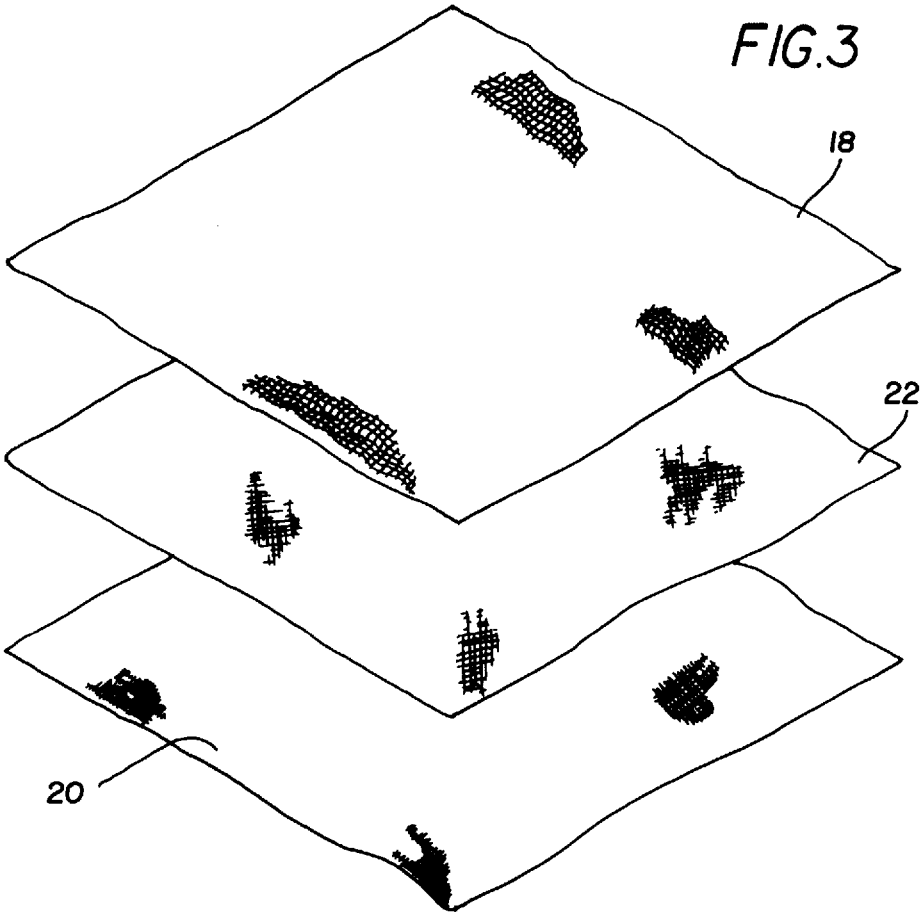
FIG. 3 is isometric view of the layers of fabric making up the panty hose.
Figure 4:
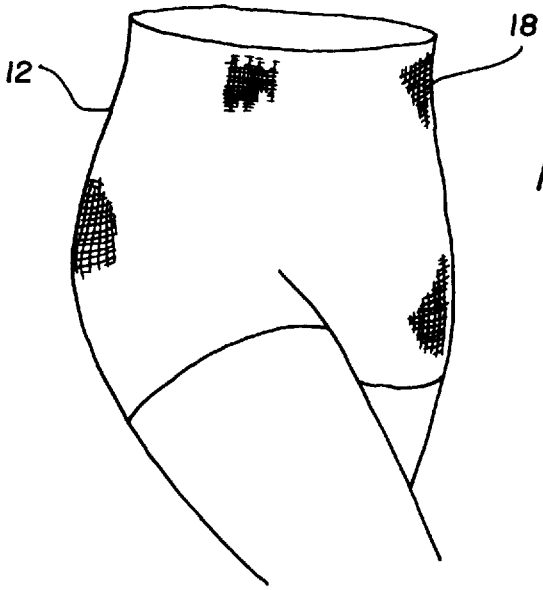
FIG. 4 is a sectional view of the lower trunk portion of the panty hose.

FIG. 3 shows the three layers of fabric. FIG. 2 shows the toe portion with a reinforcing weave of yarn 30. The three layers of fabric have the nylon being substantially throughout and making up about 80% of the main body yarn. The nylon is adjacent the skin of the wearer when the panty hose are worn. The THINSULATE insulated polyester material is superimposed over the nylon and the spandex is superimposed on the thinsulated material. Finally, the THINSULATE insulated polyester material provides insulation for protecting the lower torso from cold temperatures.

The present invention thermal panty hose garment is for wearing during the winter months. The present invention when worn will keep legs and feet warm in cold and freezing temperatures. The three layers of fabric will prevent feet from becoming numb or frostbitten. The thermal panty hose garment can have a cotton lined gusset. The present invention may also come with a control top lower trunk portion. The three layers of fabric provide sheerness and flexibility in a manner like other panty hose. But, the THINSULATE insulated polyester will provide additional protection from the cold.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A thermal panty hose garment comprising:

a lower trunk portion, two leg sections and feet sections being integrally knitted together, the lower trunk portion being characterized by a spandex fabric having substantially stretchable and retractable conforming fit characteristics, the two leg sections being characterized by at least three layers of fabric consisting of spandex, nylon and insulated polyester, the feet sections each being fabricated of three layers of material consisting of spandex, nylon and insulated polyester and having a toe portion, the toe portion having a reinforcing weave of yarn, the three layers of fabric having the nylon being substantially throughout and being 80% of a main body yarn, the nylon being adjacent the skin of the wearer, the insulated polyester being superimposed over the nylon and the spandex being superimposed on the insulated polyester, the insulated polyester providing insulation for protecting the lower torso from cold temperatures.

2. A thermal panty hose garment comprising:

a lower trunk portion, two leg sections and feet sections being integrally knitted together, the two leg sections being characterized by at least three layers of fabric consisting of spandex, nylon and THINSULATE insulated polyester material insulated polyester, the feet sections each being fabricated of three layers of fabric consisting of spandex, nylon and insulated polyester and having a toe portion, the insulated polyester being superimposed over the nylon and the spandex being superimposed on the insulated polyester, the insulated polyester providing insulation for protecting the lower torso from cold temperatures.

3. The thermal panty hose garment as set forth in claim 2, wherein the lower trunk portion being characterized by a spandex fabric having substantially stretchable and retractable conforming fit characteristics.

4. The thermal panty hose garment as set forth in claim 2, wherein the toe portion having a reinforcing weave of yarn.

5. The thermal panty hose garment as set forth in claim 2, wherein the nylon being substantially throughout and being 80% of a main body yarn, and the nylon being adjacent the skin of the wearer.

* * * * *